US006484793B1

(12) United States Patent
Scheurecker

(10) Patent No.: US 6,484,793 B1
(45) Date of Patent: Nov. 26, 2002

(54) GUIDE ROLLER

(75) Inventor: Werner Scheurecker, Linz (AT)

(73) Assignee: Voest-Alpine Industrieanlagenbau GmbH (AT)

( * ) Notice: Subject to any disclaimer, the term of this patent is extended or adjusted under 35 U.S.C. 154(b) by 0 days.

(21) Appl. No.: 09/584,219

(22) Filed: May 31, 2000

(30) Foreign Application Priority Data

Jun. 2, 1999 (AT) ..... 989/99

(51) Int. Cl.[7] ..... B22D 11/12
(52) U.S. Cl. ..... 164/448; 164/442
(58) Field of Search ..... 164/448, 442, 164/428

(56) References Cited

U.S. PATENT DOCUMENTS 3,965,974 A * 6/1976 Sernetz et al. ..... 165/89
4,000,553 A * 1/1977 Spannlang et al. ..... 29/115
4,010,528 A * 3/1977 Bohmer ..... 29/125
4,071,073 A * 1/1978 Bollig et al. ..... 164/448
4,137,963 A * 2/1979 Langer et al. ..... 164/448
4,222,433 A * 9/1980 Marti et al. ..... 164/448
4,351,383 A * 9/1982 Gladwin ..... 164/448
5,649,889 A * 7/1997 Warner, III ..... 492/16

FOREIGN PATENT DOCUMENTS

| | | |
|---|---|---|
| AT | 290750 | 6/1971 |
| AT | 335093 | 2/1977 |
| DE | 2420514 | 7/1975 |
| DE | 2423224 | 11/1975 |
| DE | 2742570 | 7/1980 |

* cited by examiner

*Primary Examiner*—M. Alexandra Elve
*Assistant Examiner*—Len Tran
(74) *Attorney, Agent, or Firm*—Ostrolenk, Faber, Gerb & Soffen, LLP

(57) ABSTRACT

In order, in a guide roller for continuous-casting plants, which is formed by a plurality of aligned roller portions, to avoid the creeping movements of the guide roller in the axial direction and thermally induced distortions in it, it is proposed that a roller portion adjacent on both sides of roller portions either be provided at its two ends with roller journals carrying support bearings, and these roller journals engage into recesses of the adjacent roller portions, or be provided at its two ends with recesses, and roller journals, having support bearings, of the adjacent roller portions engage into these recesses.

11 Claims, 2 Drawing Sheets

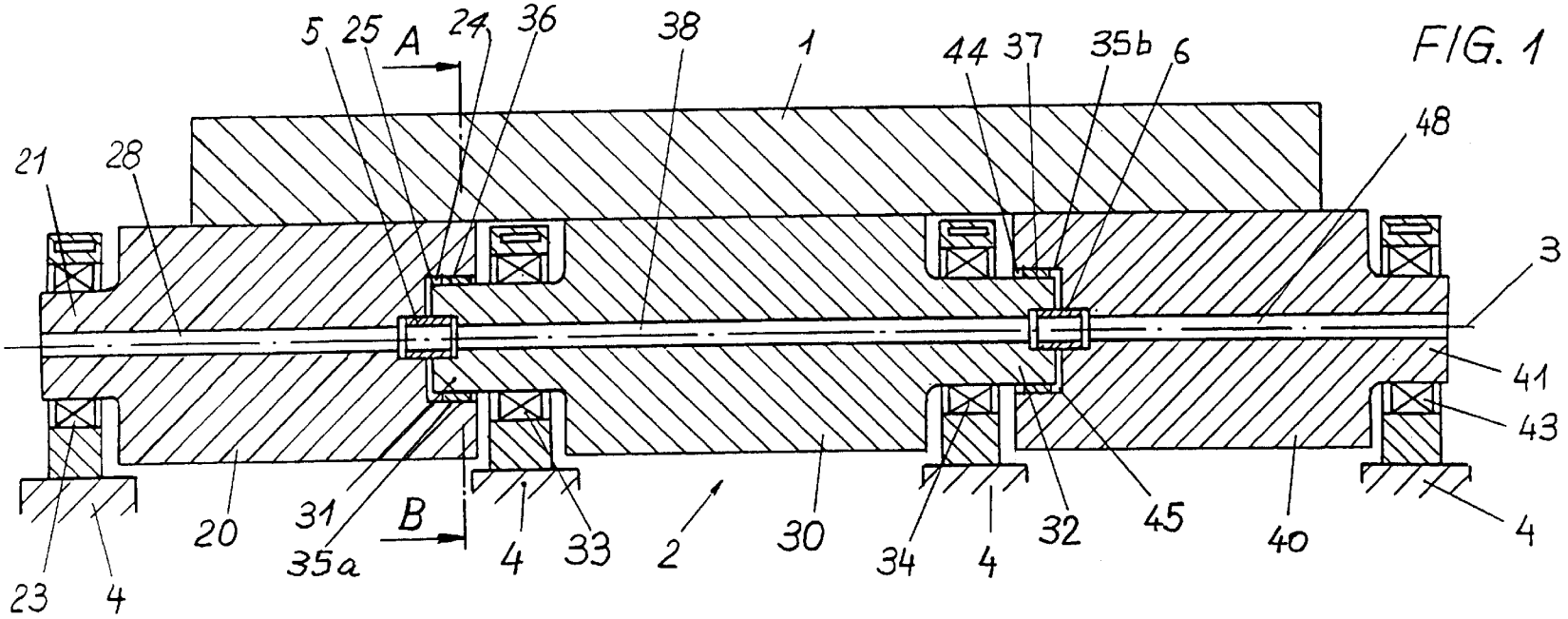
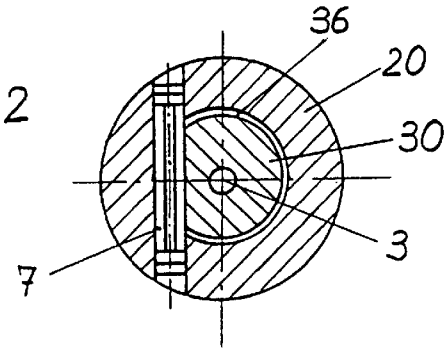
FIG. 2

GUIDE ROLLER

FIELD OF THE INVENTION

The invention relates to a guide roller for continuous-casting plants, which is subdivided into a plurality of roller portions aligned with one another, adjacent roller portions being connected to a roller journal carrying a support bearing, and the roller portion which terminates in a roller journal engaging into a recess of the adjacent roller portion.

BACKGROUND OF THE INVENTION

In plants for the continuous casting of metal strands, in which the ratio of strand width to strand thickness is very high, such as, for example, slabs or thin slabs, the strand guide rollers supporting and guiding the strand along its wide sides are subdivided into a plurality of roller portions with aligned axes.

In the continuous-casting plant known from AT-B 290 750, the roller bodies arranged next to one another are mounted on a common axis, and between the individual roller bodies engage support members or shaft holders which are supported on curved longitudinal girders or on rear-engaging beams or on a fixed frame structure, as is customary on continuous-casting plants of this type. Supporting all the roller bodies individually necessitates an extremely large number of bearings on the common axis, the susceptibility of this construction to faults being very high because of the complicated supply of lubricant to the many bearing points.

AT-B 335 093 discloses a strand guide roller constituting the pre-characterising clause, which is formed by a plurality of roller portions aligned with and identical to one another and which is braced by means of a tie passing centrally through all the roller portions. The asymmetric design of the strand guide roller results in this strand guide roller experiencing a creeping movement in the axial direction, which leads to increased wear in the mountings and on the roller portions adjacent to the connection. The same problem arises in an embodiment of the strand guide roller according to DE-C 27 42 570.

DE-B 24 20 514 likewise discloses a guide roller for continuous-casting plants which is multiply mounted and is subdivided into identical roller portions. Here, too, the above-described disadvantages due to the asymmetric design of the guide roller become evident.

DE-A-24 23 224 discloses a subdivided multiply mounted guide roller for continuous-casting plants, which is formed by roller portions lined up alternately with one another in alignment and by shaft stubs carrying bearings. The multiplicity of components of complicated design results in increased manufacturing costs and high outlay in terms of assembly.

It is also known to arrange a plurality of solid-body rollers next to one another and to mount them individually, on both sides, on a fixed frame structure of the continuous-casting plant. As a result, necessarily, two journal bearings with a large space requirement are positioned next to one another and the billet is not supported in this region, thus causing the billet shell to bulge out and giving rise to increased internal expansions in the billet. The susceptibility of the billet to cracking is therefore increased.

The invention aims to avoid the disadvantages and difficulties described, and its set object is to propose a strand guide roller, by means of which creeping movements of the strand guide roller in the axial direction and distortions dependent on the thermal conditions in the strand guide roller are avoided. Another aim of the invention is to form the strand guide roller from components to be manufactured cost-effectively and to design,it for easy maintenance.

SUMMARY OF INVENTION

This object is achieved, according to the invention, in that a roller portion which is adjacent on both sides of roller portions either is provided at its two ends with roller journals carrying support bearings, and these roller journals engage in recesses of the adjacent roller portions, or is provided at its two ends with recesses, and roller journals, carrying support bearings, of the adjacent roller portions engage into these recesses. Due to the symmetrical design of a central roller portion flanked by further roller portions, the load exerted by the weight of the strand on the entire strand guide roller results in an optimum, specifically minimized and symmetrical flexion of the strand guide roller. A preferred embodiment is formed by a centrally arranged roller portion which is provided at its two ends by roller journals carrying support bearings. The number of the adjacent roller portions is the same on both sides for reasons of symmetry.

In a refinement which is simple in manufacturing terms and has low wear, the roller journal of a roller portion is mounted in the recess of the adjacent roller portion in sealed-off mountings, preferably sealed-off slide bushes or spherical bearings. It thus becomes possible for relative movements, above all thermally induced axial movements and tilting movements resulting from the roller flexion, to take place without any stress.

According to a further refinement of the invention, adjacent roller portions are secured against rotation and axial displacements relative to one another by means of a positive bracing device, preferably having a clamping sleeve passing through them transversely to their longitudinal extent. The clamping-sleeve connection, in particular, proves to be of simpler design and more cost-effective than the tie bracing known from AT-B 335 093. Moreover, the clamping sleeve fixes by positive connection and thereby prevents a possible crawling movement with friction and wear in the journal connections. Crawling movements of this kind occur, during the normal operation of a plant, due to the uneven wear of the roller surface as a result of the casting of slabs of different width. Preferably, the bracing device passes through the mounting of the roller journal of a roller portion in the recess of the adjacent roller portion.

When the cast strand runs through the supporting and guiding structure of the continuous-casting plant, the guide rollers are subjected to thermal loading due to linear contact with the hot strand and to the heat radiated from the latter. In order to cool the guide rollers, the roller portions have a central coolant duct, and the coolant ducts of adjacent roller portions are connected to coolant cross-over sleeves.

The Figures illustrate, for a non-driven guide roller, a non-restrictive exemplary embodiment, from which further advantages and features of the present invention may be gathered.

FIG. 1 shows a diagrammatic sectional illustration of a guide roller formed from three roller portions.

FIG. 2 shows a cross section through the guide roller in the region of connection of two adjacent roller portions along the sectional plane A-B.

DETAILED DESCRIPTION

Figure 3:
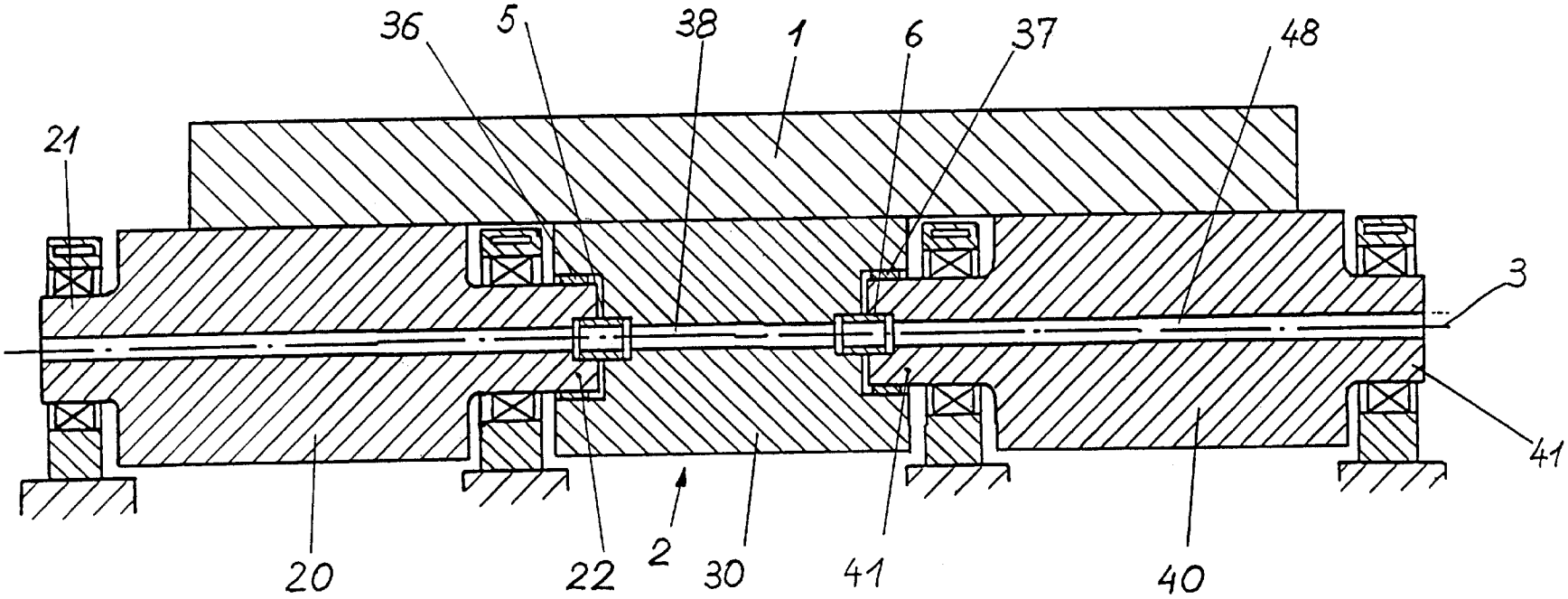
FIG. 3 shows a diagrammatic sectional illustration of a further embodiment of a guide roller constructed from three roller portions.

In the following description of the Figures, identical components are given the same reference symbols.

In FIG. 1, 1 designates a strand which has, for example, a slab or thin slab cross section and which rests on a guide roller 2 or the strand shell of which is supported by the guide roller. In continuous-casting plants, a multiplicity of guide rollers arranged one behind the other in the casting direction conventionally form a roller corset supporting the hot strand. The guide roller 2 is formed from a plurality of roller portions 20, 30, 40 along an aligned axis of rotation 3. The roller portions 20, 30, 40 terminate in roller journals 21, 31, 32, 42 and are supported via support bearings 23, 33, 34, 43 on the merely suggested strand guide structure 4 of the continuous-casting plant. The roller portions 20, 40 have central recesses 24, 44, into which the roller journals 31, 32 of the roller portion 30 engage or project and are guided there in the recesses 24, 44 via sealed-off mountings 36, 37 formed by sealed-off slide bushes or spherical bearings.

FIG. 1 illustrates a particularly advantageous embodiment of the guide roller 2 which is distinguished by its symmetrical design and the favourable mutual support of the roller portions. The middle roller portion 30 terminates, on the two end faces, in roller journals 31, 32 which are rotatably mounted in support bearings 33, 34 and by means of which the strand weight forces exerted predominantly on the middle roller portion 30 are diverted directly into the strand guide structure 4 via these support bearings 33, 34. Roller journals 31, 32 projecting through the support bearings 33, 34 engage into the recesses 25, 45 of the adjacent roller portions 20, 40 and support the latter. Due to the force distribution which is obtained as a result, the flexion of the middle roller portion 30 is minimized.

In order to maintain uniform temperature conditions in the guide roller 2, the individual roller portions 20, 30, 40 have centrally arranged coolant ducts 28, 38, 48 passing through them and, in the transitional region between adjacent roller portions, are connected to coolant cross-over sleeves 5, 6. The support bearings 23, 33, 34, 43 exposed to the thermal radiation of the hot strand are connected, in a way not illustrated, to coolant and lubricant lines, the same thing being provided, if required, to the mountings 36, 37.

FIG. 2 shows a section through the guide roller 2 in the region of the mounting 36. The roller portions 20, 30 and the mounting 36 are connected fixedly in terms of rotation, transversely to the axis of rotation 3 of the guide roller, by means of a bracing device 7 which is formed by a clamping bolt.

FIG. 3 illustrates a further embodiment of the guide roller 2, in which the roller journals 22, 41 are assigned to the roller portions 20, 40 and the middle roller portion 30 receives on its two end faces recesses 35*a*, 35*b*, into which engage roller journals 22, 41 carrying the support bearings 33, 34. The said roller journals are supported there in a similar way to the embodiment according to FIG. 1.

The preferred embodiment of the guide roller is formed by three roller portions. However, the invention is not restricted to three roller portions. Even if there are five roller portions, it is possible for the guide roller to have a symmetrical design, in which case, even in this embodiment, the central roller portion is designed according to the invention.

What is claimed is:

1. A guide roller for continuous casting plants, the guide roller being rotatable about an axis of rotation and comprising:

a central roller portion having symmetrical axially opposite first and second ends;

two side roller portions coaxially located at opposite ends of the central roller portion, each of the side roller portions having a first end adjacent to one end of the central roller portion, and axially opposite second end;

a non-rotatable joint between the central roller portion and the first end of each of the side roller portions, each non-rotatable joint being comprised of:

a recess at the end of one of the joined roller portions;

an axial projection of reduced cross section at the end of the other of the joined roller portions that fits into the recess; and locking devices operative to prevent relative axial and rotational displacement of the side and central roller portions with respect to one another;

first and second rotatable joints between the roller and a fixed support, the rotatable joints being comprised of respective first and second rotational bearings mounted on the fixed support and on the axial projections; and first and second further rotatable joints between the side roller portions and the fixed support, the further rotatable joints being located at the second ends of the side roller portions.

2. The guide roller as defined in claim 1, wherein:

the recesses are located on the ends of the central roller portion; and the axial projections are located on the first ends of the side of the roller portions.

3. The guide roller as defined in claim 1, wherein:

the axial projections are located on the ends of the central roller portion; and the recesses which comprise the non-rotatable joints are located on the first ends of the side roller portions.

4. The guide roller as defined in claim 1, further including sealed off mountings respectively located between the recesses and the axial projections.

5. The guide roller as defined in claim 4, wherein each of the mountings is comprised of a slide bushing.

6. The guide roller as defined in claim 4, wherein each of the mountings is comprised of a spherical bearing.

7. The guide roller as defined in claim 4, wherein each of the clamping sleeves passes through a respective one of the sealed off mountings.

8. The guide roller as defined in claim 1, wherein the locking devices are comprising of clamping sleeves that pass through the adjacent side and central roller portions transversely to the axis of rotation.

9. The guide roller as defined in claim 1, further including:

axially aligned coolant ducts extending through the central and side roller portions; and a sleeve located at each of the non-rotatable joints to provide flow communication between the adjacent coolant ducts.

10. The guide roller as defined in claim 1, wherein the first and second further rotatable joints are comprised of third and fourth rotational bearings mounted on the fixed support which receive journals extending from the second ends of the side roller portions.

11. The guide roller as defined in claim 1, wherein the axial projections comprising the non-rotatable joints each have circular cross-sections of reduced diameter relative to the roller portion from which they project, and which form journals positioned in the first and second rotational bearings, and which have respective ends that extend beyond the first and second bearings into the recesses in the adjacent roller portions.

* * * * *